US008881321B1

(12) United States Patent
Ludlow et al.

(10) Patent No.: US 8,881,321 B1
(45) Date of Patent: Nov. 11, 2014

(54) SPA CONSTRUCTION AND INSTALLATION SYSTEM

(71) Applicant: Bullfrog International, L.C., Bluffdale, UT (US)

(72) Inventors: David J. Ludlow, Salt Lake City, UT (US); Stephen M. Fleischer, Orem, UT (US); Richard Alex Eddington, South Jordan, UT (US)

( * ) Notice: Subject to any disclaimer, the term of this patent is extended or adjusted under 35 U.S.C. 154(b) by 0 days.

(21) Appl. No.: 13/621,826

(22) Filed: Sep. 17, 2012

Related U.S. Application Data

(63) Continuation of application No. 12/265,711, filed on Nov. 5, 2008, now abandoned.

(60) Provisional application No. 60/986,262, filed on Nov. 7, 2007.

(51) Int. Cl.
*E04H 4/00* (2006.01)

(52) U.S. Cl.
USPC ..... 4/506

(58) Field of Classification Search
USPC ..... 4/506, 513, 661, 612, 614, 584, 4/541.1–541.4, 546, 592–593; 52/220.1
See application file for complete search history.

(56) References Cited

U.S. PATENT DOCUMENTS

| | | | | | |
|---|---|---|---|---|---|
| 3,561,019 | A * | 2/1971 | Roland | 4/593 |
| 4,233,694 | A * | 11/1980 | Janosko et al. | 4/541.3 |
| 4,586,204 | A * | 5/1986 | Daniels | 4/541.4 |
| 5,494,718 | A * | 2/1996 | Adams et al. | 428/35.7 |
| 5,604,940 | A * | 2/1997 | Shimizu | 4/541.1 |
| 5,615,421 | A * | 4/1997 | Watkins et al. | 4/506 |
| 5,741,453 | A * | 4/1998 | Kennedy | 264/237 |
| 6,079,170 | A * | 6/2000 | Slebos | 52/220.1 |
| 6,381,768 | B1 * | 5/2002 | Herman | 4/541.1 |
| 6,601,247 | B2 * | 8/2003 | Shimizu | 4/584 |
| 6,854,223 | B1 * | 2/2005 | Holland | 52/169.7 |
| 7,020,910 | B1 * | 4/2006 | Horwood | 4/541.1 |
| 7,228,574 | B2 * | 6/2007 | Hansen et al. | 4/619 |
| 8,095,998 | B2 * | 1/2012 | Lau | 4/541.5 |
| 8,136,178 | B2 * | 3/2012 | Lerma | 4/541.1 |
| 2004/0055082 | A1 * | 3/2004 | Loyd et al. | 4/541.1 |
| 2004/0073996 | A1 * | 4/2004 | Hill | 4/584 |
| 2005/0210575 | A1 * | 9/2005 | Erb | 4/541.1 |
| 2006/0015998 | A1 * | 1/2006 | Whitinger et al. | 4/545 |
| 2006/0137087 | A1 * | 6/2006 | Carreau et al. | 4/541.1 |
| 2006/0137088 | A1 * | 6/2006 | Walker | 4/541.1 |
| 2008/0098509 | A1 * | 5/2008 | Kantor et al. | 4/541.1 |
| 2009/0255051 | A1 * | 10/2009 | Turpen | 4/584 |

* cited by examiner

*Primary Examiner* — Mark Wendell
(74) *Attorney, Agent, or Firm* — Amy Fiene; James Sonntag

(57) ABSTRACT

A system for easier manufacture and installation of a spa using a unitary base with molded integral electrical chase-ways and with vertical support members.

5 Claims, 5 Drawing Sheets

SPA CONSTRUCTION AND INSTALLATION SYSTEM

CROSS REFERENCE TO RELATED APPLICATIONS

This application claims priority as a continuation from U.S. Non-provisional application Ser. No. 12/265,711, filed Nov. 5, 2008 and claims priority from U.S. Provisional Application 60/986,262, filed Nov. 7, 2007, both of which are incorporated by reference.

BACKGROUND OF INVENTION

While there have been advances in spa construction, many of the manufacturing and installation techniques have not changed a great deal. Accordingly, techniques that streamline manufacturing and installation are a continuing need.

SUMMARY OF INVENTION

A molded foundation for a spa is constructed in the form of a generally flat base tray with a horizontal base and with an vertical peripheral wall. The base is configured to lie upon a horizontal ground surface and provide a foundation for a spa. On the bottom surface of the base are indentations formed to create chaseways for electrical leads between each outside wall, and the area for the pump chamber.

DETAILED DESCRIPTION

Figure 1:
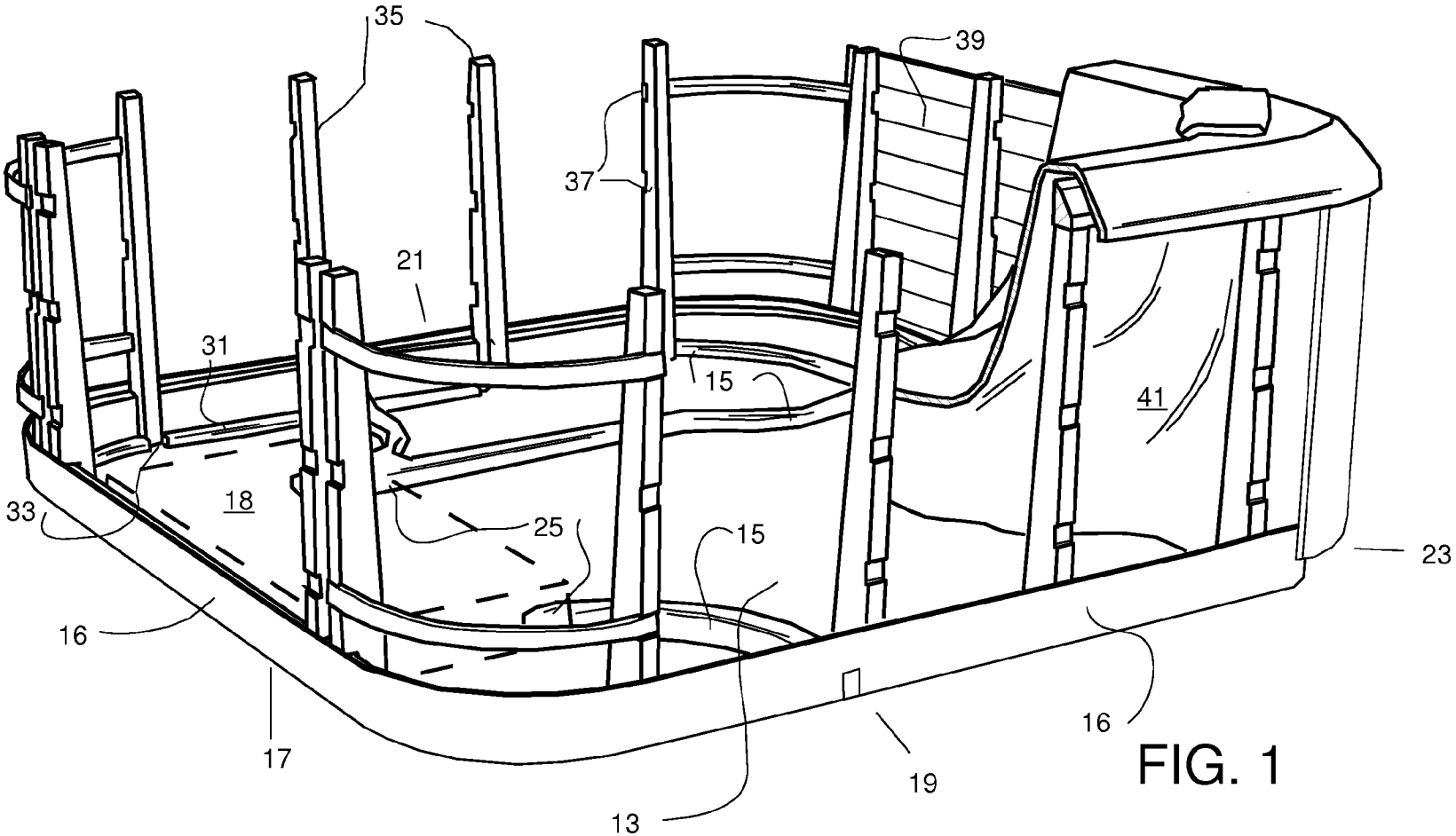
FIG. 1 is a perspective of a partially assembled spa partially in cross-section.
Figure 2:
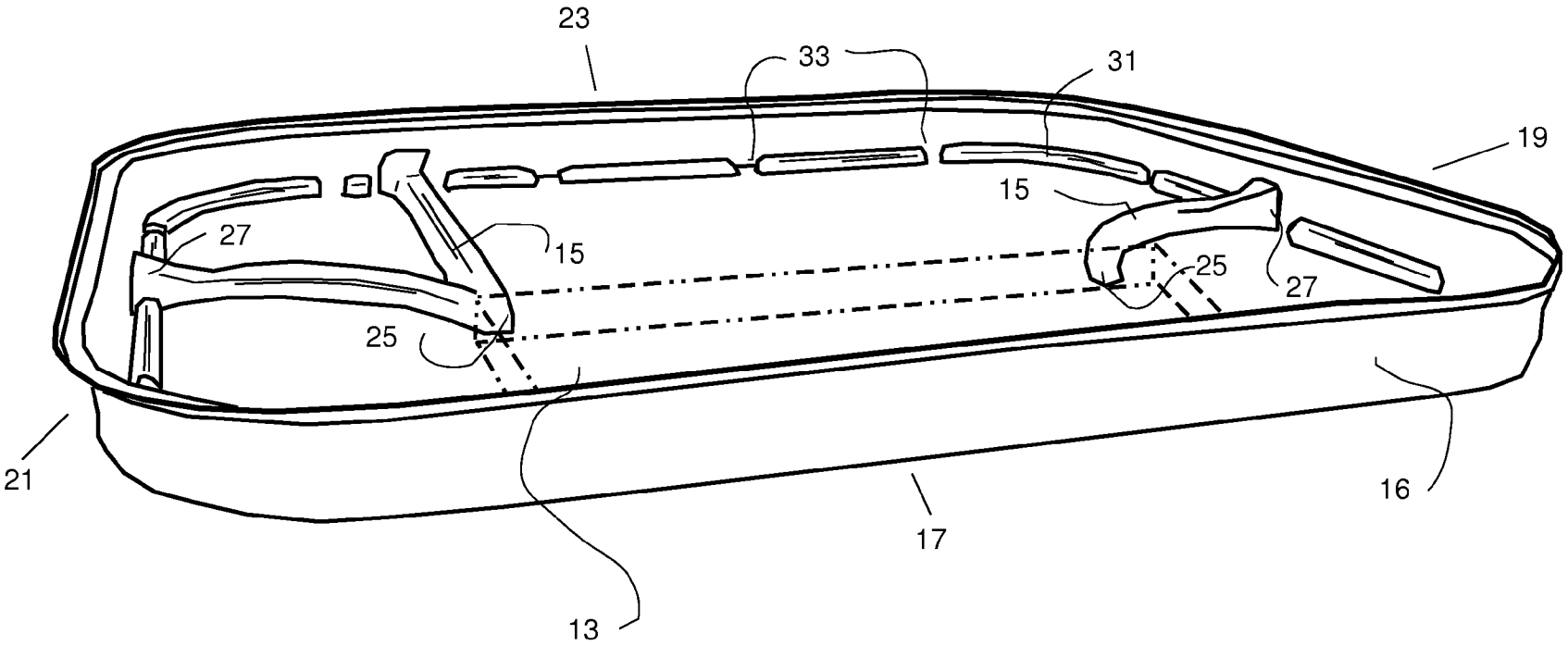
FIG. 2 is a perspective view of a spa base.
Figure 3:
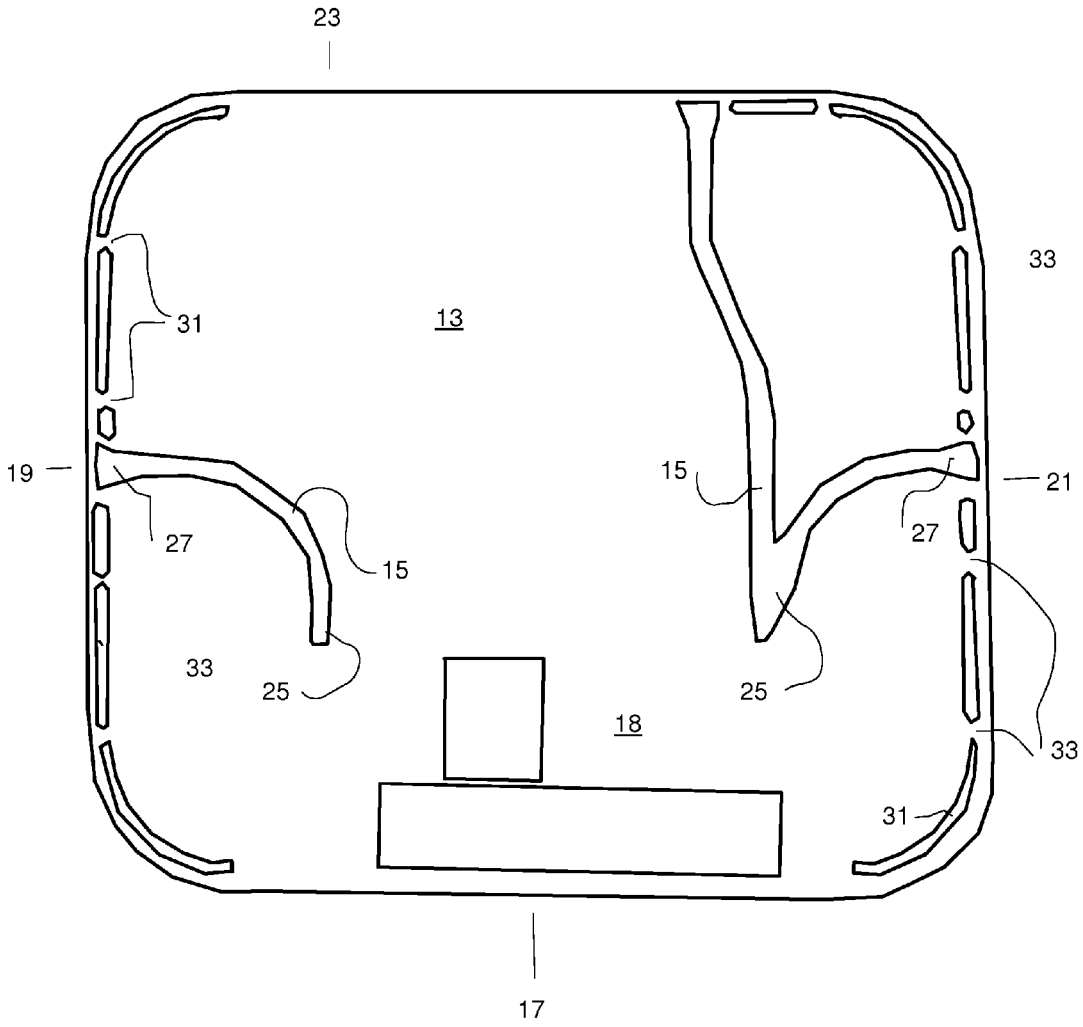
FIG. 3 is a bottom view of a spa base.

Reference is now made to FIG. 1, which is a perspective view of a partially assembled spa, and FIG. 2, which is perspective view of the base in FIG. 1. Reference is also made to FIG. 3 which is a view from the bottom of the tray, showing particularly the location of molded indentations in the bottom. Shown is a base 13 with indentations are in the bottom surface of the base so that cavities, recesses, or passages, are formed between the base and the ground surface. The spa base 13 is generally tray-like in construction with a generally flat bottom for lying upon the ground, and acts as the foundation of the spa.

In the illustrated spa base, indentations are molded into the bottom to give the base added functionality. Certain of the indentations 15 are formed to function as channels, conduits, or chaseways for electrical cabling extending from the surface area designed as the location of the pump chamber 18 to or near the peripheral wall 16 at edge of the base. When a spa is installed on location, the installer can run electrical supply cables through an appropriate chaseway, rather than having to drill, cut or modify the spa. Referring to the side where the pump chamber is located as the front 17, a chaseway 15 runs from the left side, the right side 21 and from the back side 23. In the illustration, the chaseways from the right side and the back side come together as they come to the pump chamber area. However, any of the chaseways may enter the pump chamber area separate or together, depending upon the configuration of the spa and pump chamber. The ends 25 of the chaseways at the pump chamber are shown as blind, and upon installation the end of the selected chaseway is cut to provide an opening for the cabling. At the ends 27 of the chaseways near the wall 16, the chaseway ends can also be blind, by terminating the chaseway shortly before the edge (as particularly seen in FIG. 3). To open the chaseway, the installer cuts through the end of the chaseway and cuts out an opposing piece of the outside wall to provide passage for electrical wiring through the wall into chaseway. If a particular chaseway is not used for the corresponding outside wall remains uncut and unblemished. Thus, chaseways can be provided for possible installation of electrical cables at any side, with the only visible alteration at a used chaseway location.

Referring specifically to FIG. 3, molded indentations 15 are shown for the chaseways. As shown in the illustrated example, the chaseways 15 extend from the area of the pump chamber 18 just before the wall 27. When a chaseway is to be used for electrical connection, the installer cuts out the small portion adjacent the wall and the end of the chaseway adjacent to the wall to remove the small dam-like portion formed between the end of the chaseway indentation and the wall. In addition, the end at the pump chamber is cut out to provide access between the pump chamber and the chaseway.

The intent of the chaseways is to provide easy installation of the electrical power source during installation of the spa. To electrically connect the equipment installed in the pump chamber to an outside electrical source, the installer does not need to orient the side of the pump chamber spa nearer the electrical source, or consider cutting a passage for the electrical connection through the spa where the electrical source is not closest to the pump-chamber side. This is because the electrical connections can be easily installed from any side of the spa. The installer chooses the side closest or most convenient to the electrical source, cuts out the ends of the chaseway associated with that side, and installs electrical leads through the chaseway, providing electrical connection between the electrical source and the pump chamber. If the most convenient side is the side of the pump chamber, then the chaseways are unused, and the electrical connections can be installed directly through that side.

Also shown in FIG. 3 are indentations 31 formed to function as finger-hold grooves. These grooves provide finger holds 31 for installer to pick up and move the spa. The finger-hold grooves are shown as discontinuous. At the chaseways, these discontinuities are to provide a clean passage for the electrical cabling, but otherwise have no other function.

Certain other discontinuities between finger-hold grooves function as saddles.

Figure 4:
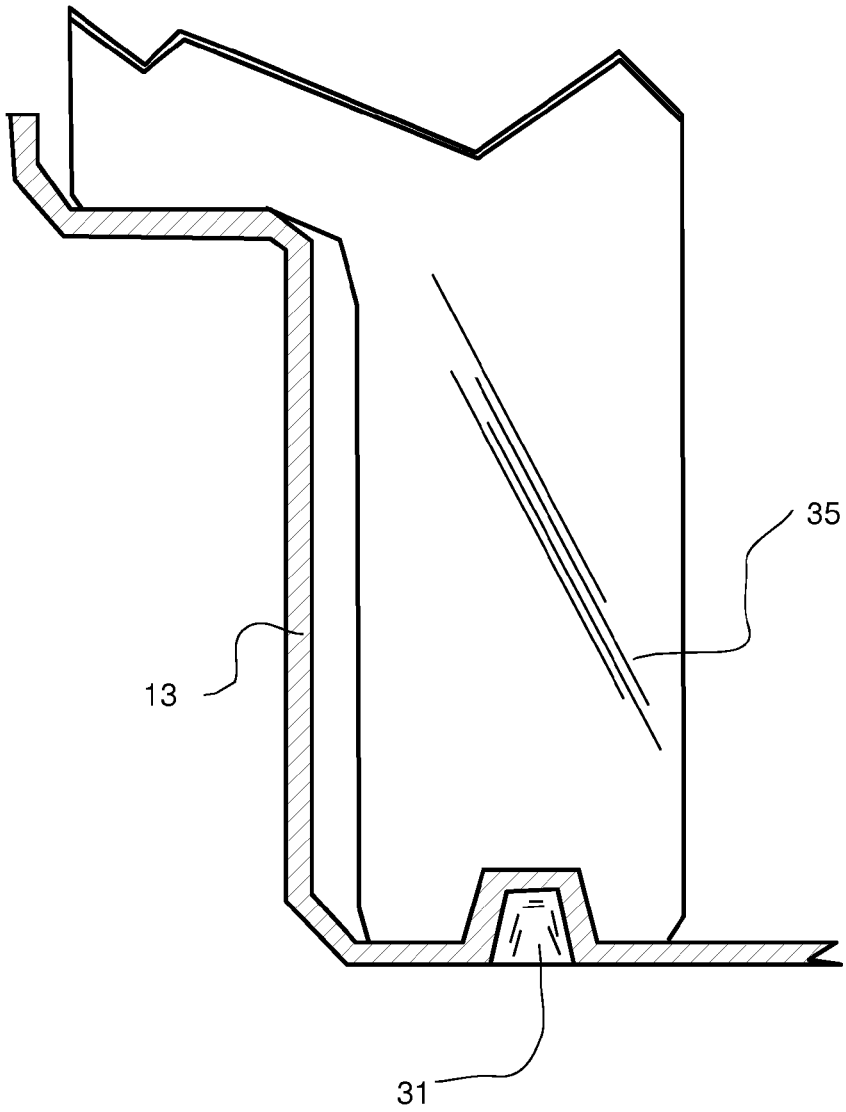
FIG. 4 is a cross-sectional view of a portion of the spa showing juncture of the vertical with the base.
Figure 5:
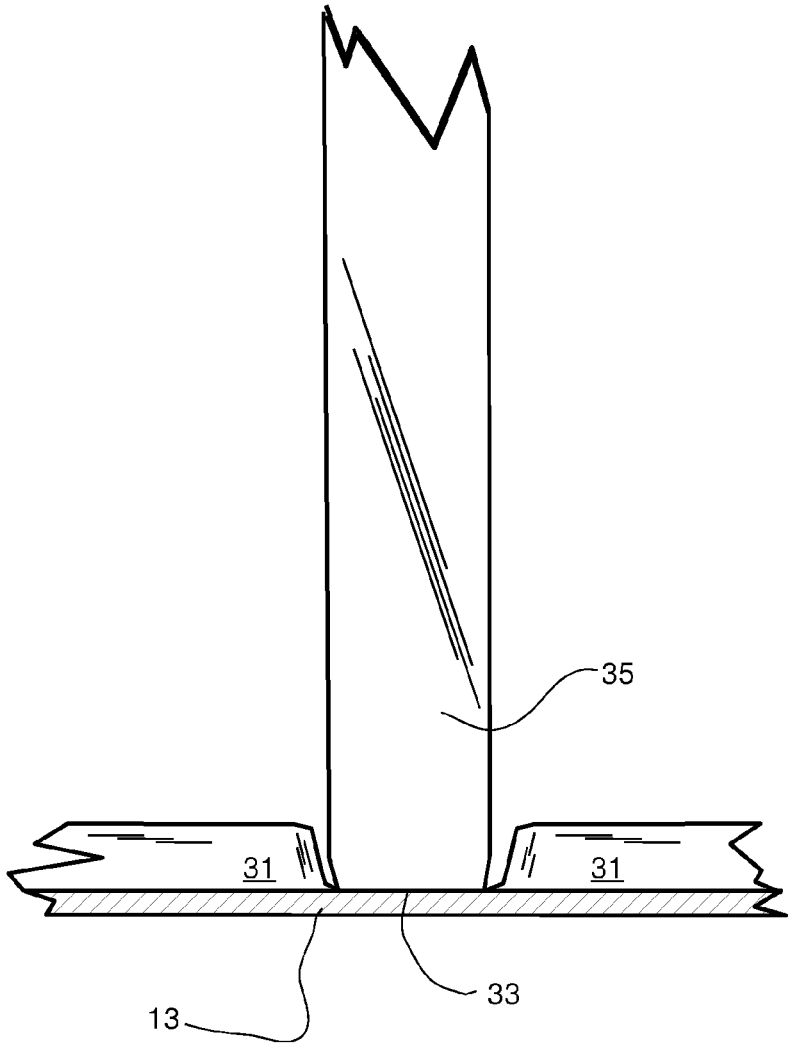
FIG. 5 is another cross-sectional view of a portion of the spa showing juncture of a vertical member with the base.

The saddles are formed on the upper side of the base as protrusions where the finger hold cavities are formed in the bottom. Saddles can also be formed separately as protrusions on the upper surface. The saddles are configured to receive vertical support members for the sides of the spa. Referring again to FIG. 1, vertical members 35 are disposed around the periphery of the base to support the side wall of the spa, and are placed around the base during construction of the spa. The saddles 33 are to assist a spa builder to register the correct location of the vertical members, and assist their alignment. Reference is additionally made to FIG. 4 and FIG. 5. FIG. 4 is a side view of the saddle region of the base with a vertical member 35 in the saddle, and FIG. 5 the same saddle region from the back (viewed from inside the spa toward the outside). The lower end of the vertical member rests in the saddle 33 created by molded indentations on each side. In the illustrated example, the indentations also function as finger holds, but indentations just to function to form the saddle can be used, as long as the indentations form appropriate spaced shoulders to register placement and orientation of the vertical member.

Referring to FIG. 1, the vertical members 35 are standardized premanufactured shapes. The vertical members can be molded from a polymeric material, or cut from structural materials, such as a polymeric material, wood, metal, or the like. All the vertical members for a spa can be same, so assembly can be quicker. Since they are premanufactured, they don't require fitting, cutting, or other alterations during the assembly. For corners, the vertical members may have grooves 37 for placement of splines that shape and reinforce corner structure of the spa, or other structure to assist in attachment or installation of the any spa piece. The wall covering 39 can be a conventional material used in spa construction, such as simulated wood, or wood laminate materials. In addition, the shell can be of any suitable construction, such as a molded fiberglass shell 41 as illustrated. While there is advantage is using vertical members of the same configuration, it is understood, that vertical members of different configurations can be used, and other structural members can be installed.

An advantage with this system is that construction of the spa is from the bottom up, starting with the base. This contrasts with previously used systems, where the fiberglass spa shell is first molded, and then turned upside down. The supporting structure, that will be under the shell, is then built upon the shell by shaping and cutting wood using essentially conventional woodworking techniques. After the supporting structure and the foundation of the spa are finished, the spa is then turned over before the finishing work. In the present system, construction starts with the base, and assembly is with preformed pieces. After the molded shell is installed, the spa can remain upright as it is for the finishing work. Accordingly, the present system is more adaptable to mass-production and assembly line systems, which results in a savings in construction time and cost.

Structures may also be molded into the base for any other suitable functions. For example, indentations in the under surface or structures formed on the top surface can be provided for mounting structures, such as pads, and the like, for pumps and other structures in the area for the pump chamber. Structures may also be provided to form drain or other passages, mounts for the same, and reinforcing structures in high use areas. In addition, indentations can be provided for machine lifting or handling of the spa during construction, shipment or installation.

There are several advantages in construction and installation that come from this spa construction. Among the primary advantages are:

Because of the electrical chaseways in the base, the electrical supply can be easily installed at any (e.g., the nearest or most convenient) side of the spa without undue cutting or modification of the spa structure.

Since all the structure of the spa is upon a unitary base, the spa can be built from the bottom up which is more adaptable to efficient assembly, and there is no requirement assemble the spa upside and down and turning it over for finishing.

The base as unit provides a foundation with the potential for lower vibration, quieter spa, as compared to foundations made from separate pieces.

The base and vertical members can be of molded polymeric materials, which are resistant to the problems associated with wood construction, such as degradation and dimensional change in reaction to moisture, susceptibility to insects, numerous joints in the structure, poor joint strength, and difficulty in fitting and assembly.

Because all of the vertical members can be standard and the same dimensions, and placement and orientation is simplified by base saddles, manufacture is quicker that previous methods, requiring minimum fitting and cutting, and less training by the assembler.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A foundation for spa construction comprising:

a generally flat horizontal base with a generally vertical support members comprising a wall around the periphery of the base; the base configured with a bottom surface to lie upon a horizontal ground surface and provide foundation for a spa where edges of spa containment are primarily supported by vertical support members;

the base having a pump area adjacent a first side of the base configured for location of a pump chamber;

indentations molded into the bottom surface, the indentations forming multiple cavities in the form of chaseways from the pump area to respective second sides of the base; and the cavities dimensioned for passage of electrical conductors through the chaseway[s], with the chaseway[s] accessible for electrical connection.

2. A foundation as in claim 1 wherein the chaseway[s] have closed end[s] by extending to points at the respective second sides, the chaseway[s] and second side[s] constructed such that removal of material from the base[s] at the point[s] renders the chaseway[s] in communication with outside the wall for passage of one or more electrical conductors.

3. A foundation as in claim 1 wherein the chaseway[s] have closed end[s] by extending from one or more point[s] near the pump area, the chaseway[s] constructed such that removal of base at the one or more point[s] renders the chaseway[s] in communication with the pump area for passage of one or more electrical conductors.

4. A foundation as in claim 1 where the base additionally comprises at least one set of paired upwardly extending indentations near the vertical wall, the upwardly extending indentations configured to form a saddle in the base, the saddle dimensioned to receive a vertical structural member for support of the vertical wall and configured to assist in registration and alignment of the vertical structural member;

wherein the vertical wall rests in the saddle created by the upwardly extending indentations.

5. A foundation for spa construction comprising:

a generally flat horizontal base with at least one generally vertical outside wall around the periphery of the base;

the base configured with a bottom surface to lie upon a horizontal ground surface and provide foundation for a spa;

the base having a pump area adjacent a first side of the base configured for location of a pump chamber;

indentations molded into the bottom surface, the indentations forming multiple cavities in the form of chaseways from the pump area to respective second sides of the base;

the cavities dimensioned for passage of electrical conductors through the chaseway and accessible for electrical connection;

the base additionally comprising at least one set of paired upwardly extending indentations near the at least one vertical wall, the upwardly extending indentations configured to form a saddle in the base; and the saddle dimensioned to receive a vertical structural member for primary support of the at least one vertical wall, the at least one vertical wall being the primary support for a spa containment, wherein the saddle is configured to assist in registration and alignment of the vertical structural member, wherein at least one of the paired upwardly extending indentations extends to provide a finger hold.

* * * * *